US010089934B2

(12) United States Patent
Nam et al.

(10) Patent No.: US 10,089,934 B2
(45) Date of Patent: Oct. 2, 2018

(54) DRIVING APPARATUS FOR ORGANIC ELECTRO-LUMINESCENCE DISPLAY DEVICE

(75) Inventors: Woo-Jin Nam, Gyeonggi-Do (KR); In-Su Joo, Gyeonggi-Do (KR)

(73) Assignee: LG DISPLAY CO., LTD., Seoul (KR)

( * ) Notice: Subject to any disclaimer, the term of this patent is extended or adjusted under 35 U.S.C. 154(b) by 1142 days.

(21) Appl. No.: 12/289,912

(22) Filed: Nov. 6, 2008

(65) Prior Publication Data

US 2009/0140959 A1 Jun. 4, 2009

(30) Foreign Application Priority Data

Nov. 7, 2007 (KR) ..... 10-2007-0112916

(51) Int. Cl.
*G09G 3/3233* (2016.01)
*G09G 3/3283* (2016.01)
*G09G 3/325* (2016.01)

(52) U.S. Cl.
CPC ..... *G09G 3/3283* (2013.01); *G09G 3/325* (2013.01); *G09G 3/3233* (2013.01); *G09G 2300/0842* (2013.01); *G09G 2300/0861* (2013.01); *G09G 2320/0285* (2013.01); *G09G 2320/0295* (2013.01)

(58) Field of Classification Search
CPC ... G09G 2300/0842; G09G 2300/0861; G09G 2320/0285; G09G 2320/0295; G09G 3/3233; G09G 3/325; G09G 3/3283
USPC ..... 345/82, 76–78, 90–92, 101, 102, 204, 345/207, 211, 212, 214, 55, 63; 315/169.3–169.4
See application file for complete search history.

(56) References Cited

U.S. PATENT DOCUMENTS 7,355,574 B1 * 4/2008 Leon et al. ..... 345/82
2002/0089357 A1 * 7/2002 Pae et al. ..... 327/112
2002/0093468 A1 * 7/2002 Ouchi ..... G09G 3/2022 345/55
2003/0111966 A1 * 6/2003 Mikami ..... G09G 3/3233 315/169.3
2003/0122813 A1 * 7/2003 Ishizuki et al. ..... 345/211
2005/0168491 A1 * 8/2005 Takahara et al. ..... 345/690
2005/0259052 A1 * 11/2005 Shin ..... G09G 3/325 345/77
2006/0066532 A1 * 3/2006 Jeong ..... G09G 3/3233 345/76
2006/0139259 A1 * 6/2006 Choi et al. ..... 345/76
2006/0139261 A1 * 6/2006 Choi et al. ..... 345/76
2006/0158402 A1 * 7/2006 Nathan et al. ..... 345/82
2006/0221662 A1 * 10/2006 Park ..... G09G 3/3233 365/145
2006/0238477 A1 * 10/2006 Lew et al. ..... 345/94
2007/0080905 A1 * 4/2007 Takahara ..... G09G 3/3233 345/76
2007/0195020 A1 * 8/2007 Nathan ..... G09G 3/3233 345/76

FOREIGN PATENT DOCUMENTS

KR 10-2010-0021482 A 2/2010

* cited by examiner

*Primary Examiner* — Matthew Yeung
(74) *Attorney, Agent, or Firm* — Dentons US LLP

(57) ABSTRACT

Disclosed is an apparatus that prevents a degradation of image quality due to a deterioration of a driving apparatus in an organic electro-luminescence display device.

8 Claims, 12 Drawing Sheets

DRIVING APPARATUS FOR ORGANIC ELECTRO-LUMINESCENCE DISPLAY DEVICE

This application claims the benefit of Korean Application No. 10-2007-0112916, filed on Nov. 7, 2007, which is incorporated by reference for all purposes as if fully set forth herein.

BACKGROUND OF THE INVENTION

Field of the Invention

The present invention relates to pixel driving of an organic electro-luminescence display device, and particularly, to a pixel driving apparatus of an organic electro-luminescence display device capable of avoiding a degradation of image quality due to a deterioration of a driving apparatus of an organic electro-luminescence display device.

Discussion of the Related Art

In general, an organic electro-luminescence display device is one type of flat panel display device. When a voltage is applied to two electrodes which face each other with an organic emitting layer interposed therebetween, electrons injected from one electrode and holes injected from the other electrode form pairs in the organic light emitting layer. Accordingly, luminescent molecules of the organic light emitting layer are excited to thereafter return to a ground state, thus to create energy, and such energy is emitted by the organic electro-luminescence display device. The organic electro-luminescence display device capable of emitting light as mentioned above attracts attention as a next generation display device because of its high visibility, light weight, thin configuration, and low voltage driving.

Depending on an existence of a switching device disposed in a unit pixel on an organic luminescence display panel, the organic electro-luminescence display device may be divided into an active-matrix type organic electro-luminescence display device and a passive-matrix type organic electro-luminescence display device.

FIG. 1 is a block diagram of an organic electro-luminescence display device according to the related art. As shown in FIG. 1, the organic electro-luminescence display device includes a display controller 10 for generating first and second timing signals TS1 and TS2 by receiving original video data from the exterior and a control signal for the data so as to output the first timing signal TS1 and the image signal DATA to a data driving unit 20 and output the second timing signal TS2 to a gate driving unit 30, the data driving unit 20 for outputting data voltages to data lines D1~Dm on an organic electro-luminescence display panel 40, responsive to the image signal DATA inputted from the display controller 10, the gate driving unit 30 for receiving the second timing signal TS2 from the display controller 10 to sequentially output scan signals for driving scan lines S1~Sn on the organic electro-luminescence display panel 40, and the organic electro-luminescence display panel 40 having OLED pixels PX arranged in a matrix at intersections between the scan lines S1~Sn and the data lines D1~Dm.

The pixels of the active-matrix type organic electro-luminescence display device may be divided into voltage programming type pixels, current programming type pixels and digital driving pixels.

FIG. 2 is a view showing a driving circuit of pixels PX arranged on the organic electro-luminescence display panel 40 of FIG. 1. As shown in FIG. 2, the driving circuit includes a switching transistor TFT21 driven by a scan signal SCAN applied via a scan line for transferring a data voltage $V_{DATA}$ applied via a data line to a storage capacitor C21, the storage capacitor C21 connected between a gate terminal of a driving transistor TFT22 and a terminal for a low power voltage Vss for charging the data voltage VDATA, the driving transistor TFT22 for supplying a driving current corresponding to the data voltage $V_{DATA}$ charged by the storage capacitor C21 to an organic light emitting diode OLED21, and the OLED21 having an anode connected to a terminal for a high power voltage VDD and a cathode connected to a drain of the driving transistor TFT22, for emitting light with a brightness corresponding to the driving current. Here, the transistors TFT21 and TFT22 may be implemented as N-channel thin film transistors (TFTs).

An operation of the related art pixel driving circuit having such configuration will be described with reference to FIG. 3.

The display controller 10 receives original video data provided from the exterior and a control signal for the data, thus to generate first and second timing signals TS1 and TS2. The display controller 10 then outputs the first timing signal TS1 and an image signal DATA to the data driving unit 20, and the second timing signal TS2 to the gate driving unit 30.

Positive scan signals SCAN1~SCANn, as shown in FIG. 3, are sequentially supplied per every frame to the scan lines S1~Sn on the electro-luminescence display panel 40 from the gate driving unit 30, and accordingly, the pixels PX on the corresponding scan lines (horizontal lines) are driven at each time of the supply. FIG. 2 illustrates one exemplary pixel among plural pixels PX (including a driving circuit) connected to an arbitrary scan line.

The switching transistor TFT21 is turned on by the corresponding scan signal among the scan signals SCAN1~SCANn. Here, the data voltage $V_{DATA}$ supplied from the data driving unit 20 via the corresponding data line among the plural data lines D1~Dm is charged in the storage capacitor C21 via the switching transistor TFT21, to thusly be maintained until before an emission period.

The driving transistor TFT22 is turned on by the data voltage $V_{DATA}$ charged in the storage capacitor C21, and accordingly a positive current corresponding to the data voltage $V_{DATA}$ flows via the OLED21, thus to allow the OLED21 to emit light with the corresponding brightness.

On the other hand, upon driving the organic electro-luminescence display panel 40 implemented as an amorphous silicon TFT (a-SI:H TFT), a threshold voltage Vth of the driving transistor TFT22 is shifted. In this case, the OLED21 does not normally emit light, causing a lowering of image quality. Such shift of the threshold voltage Vth may typically be caused by the data voltage $V_{DATA}$ applied to a gate node of the driving transistor TFT22 of the pixel driving circuit.

Hence, researches have recently been conducted to develop a technique for preventing the increase in the threshold voltage Vth in a manner of shifting a negative threshold voltage Vth by applying a negative voltage as well as the data voltage $V_{DATA}$ to the As shown in FIG. 2, in the organic electro-luminescence pixel driving circuit including the two transistors TFT21 and TFT22 and the one storage capacitor C21, the OLED21 can be connected to an upper or lower end of the driving transistor TFT22.

One example of being connected to the upper end of the driving transistor TFT22 may include a Dual Plate OLED (DOD) structure. This structure is advantageous in that it is the simplest structure and also uses a Black Data Insertion (BDI) driving to effectively apply a negative voltage. Here, the BDI denotes that an emission-off interval is inserted in one frame in order to alleviate a TFT afterimage characteristic and improve a video image quality such as motion blur or the like.

However, in the related art organic electro-luminescence display device, upon applying a negative voltage to the gate node of the driving transistor, if a sufficient time was not given within one frame interval, the effect of preventing the increase in the threshold voltage was decreased.

In addition, since a driving data voltage relatively increased in order to enhance a deterioration compensation of the transistor, it was difficult to prevent the increase in the threshold voltage.

SUMMARY OF THE INVENTION

Accordingly, the present invention is directed to a driving apparatus for an organic electro-luminescence display device that substantially obviates one or more of the problems due to limitations and disadvantages of the related art.

An advantage of the present invention is to detect a shift of a threshold voltage of a driving transistor due to the deterioration of the driving transistor in a pixel driving circuit of an organic electro-luminescence display device, and also to compensate for a data voltage in cooperation with the detected result.

Another advantage of the present invention is to detect the shift of a threshold voltage of a driving transistor during a period other than an emission period by using a sensing line and switching transistors in a pixel driving circuit of an organic electro-luminescence display device.

To achieve these and other advantages and in accordance with the purpose of the present invention, as embodied and broadly described herein, there is provided a pixel driving apparatus of an organic electro-luminescence display device, the apparatus including a display controller configured to output a certain image signal to a data driving unit in a detection mode, detect an output voltage of the data driving unit, and operate a shifted degree of a threshold voltage of a corresponding driving transistor on a pixel driving circuit, thus to obtain a compensation value according to the shifted degree, such that upon outputting the image signal in an emission mode, the image signal can be compensated for based upon the compensation value for output, and a pixel driving circuit including a switching transistor configured to supply a data voltage or current inputted from the data driving unit in the detection mode to an organic light emitting diode driving transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to embodiments of the present invention, examples are illustrated in the accompanying drawings.

Figure 1:
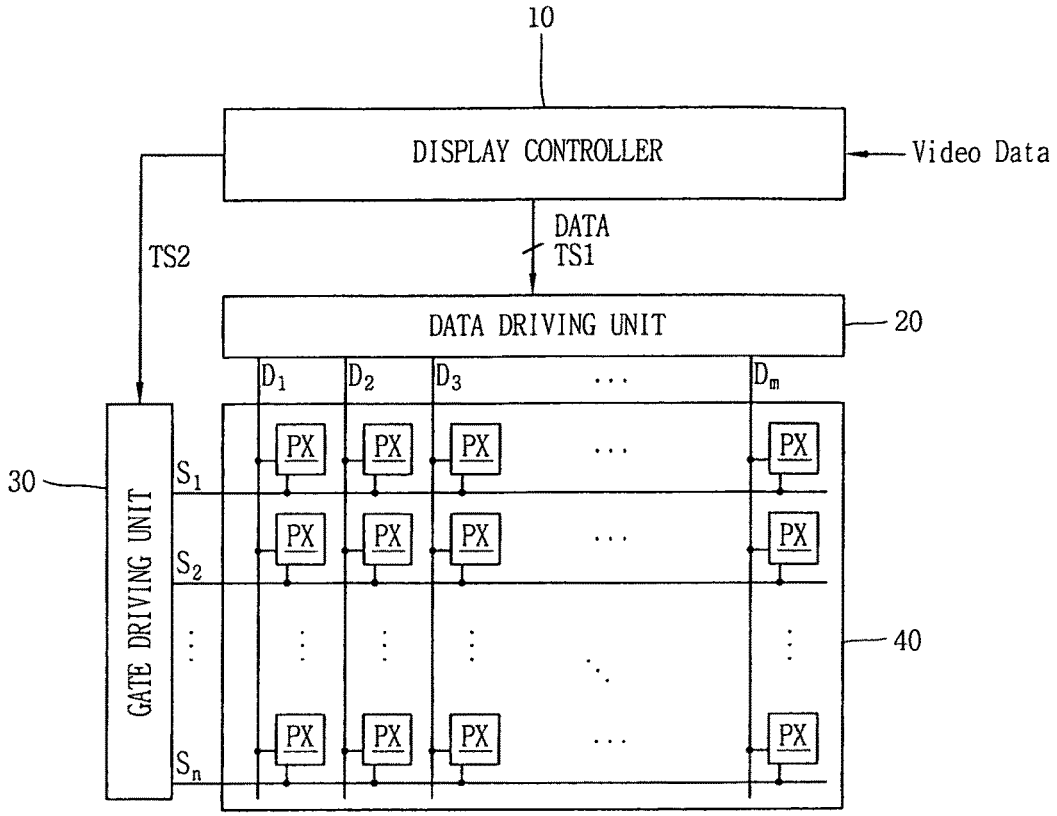
FIG. 1 RELATED ART
FIG. 1 is a block diagram of an organic electro-luminescence display device according to the related art.
Figure 2:
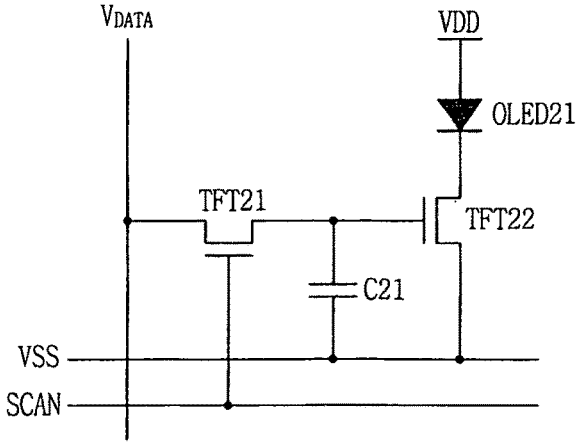
FIG. 2 RELATED ART
FIG. 2 is a view showing a driving circuit of pixels arranged on the organic electro-luminescence display panel of FIG. 1.
Figure 3:
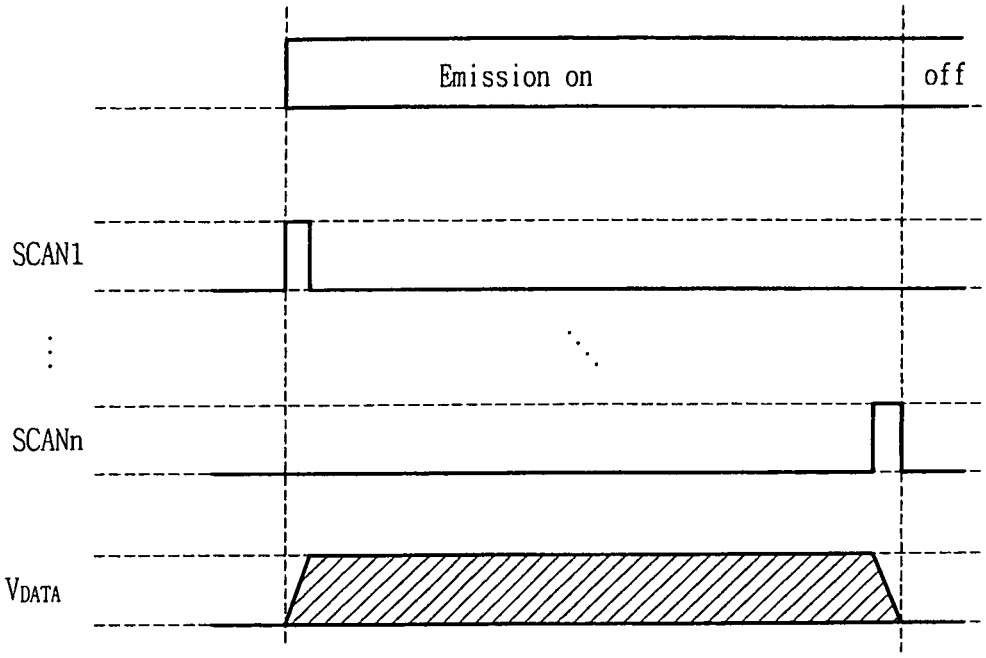
FIG. 3 RELATED ART
FIG. 3 is a waveform view of scan signal and data voltage of FIG. 2.
Figure 4:
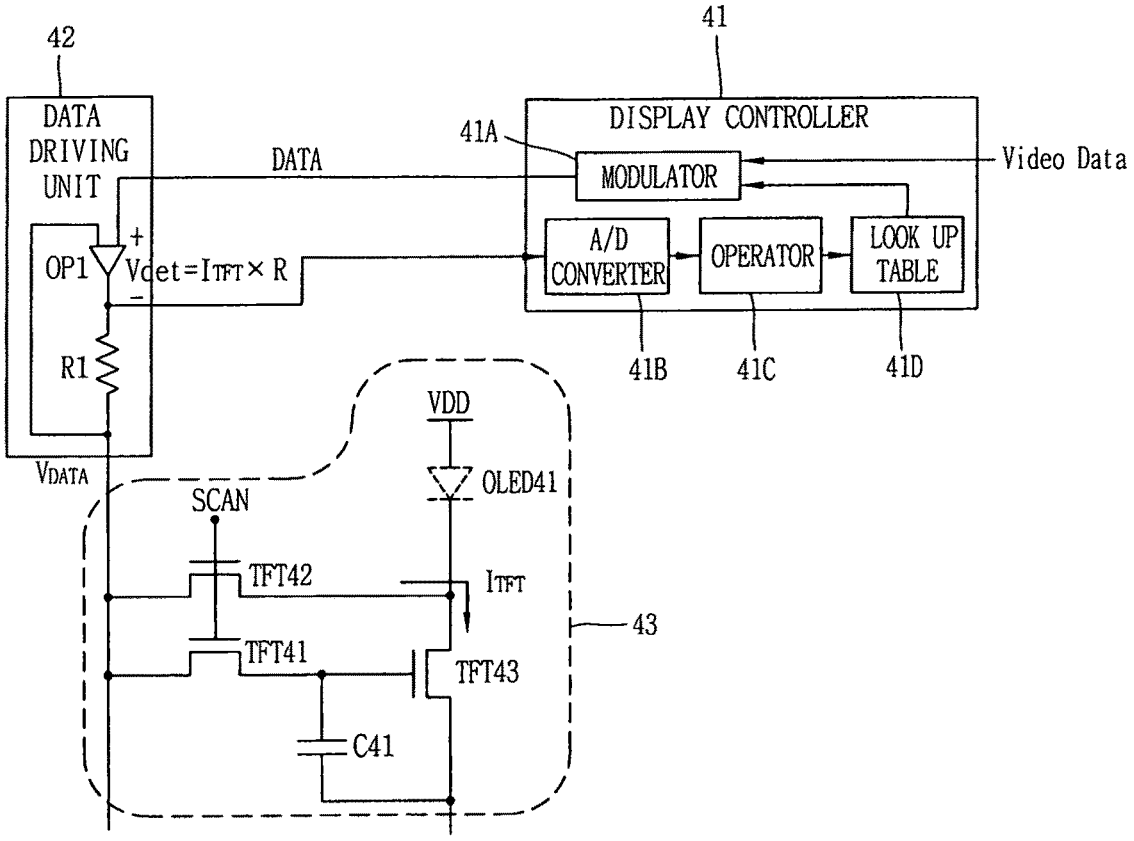
FIG. 4 is a block diagram showing a pixel driving apparatus of an organic electro-luminescence display device in accordance with one exemplary embodiment of the present invention.

FIG. 4 is a block diagram showing a pixel driving apparatus of an organic electro-luminescence display device in accordance with one exemplary embodiment of the present invention.

As shown in FIG. 4, a pixel driving apparatus in accordance with one exemplary embodiment includes a display controller 41 configured to output a preset image signal DATA in a detection mode, detect a voltage outputted to a pixel driving circuit 43 from the data driving unit, operate the shifted degree of a threshold voltage of a corresponding driving transistor, and accordingly obtain a compensation value, such that when outputting an image signal DATA corresponding to original video data inputted from the exterior during an emission period, the image signal DATA is compensated for based upon the compensation value for output, a data driving unit 42 configured to generate a data voltage $V_{DATA}$ corresponding to the image signal DATA inputted from the display controller 41 and output the generated data voltage $V_{DATA}$ to the pixel driving circuit 43, and the pixel driving circuit 43 configured to transfer the data voltage $V_{DATA}$ from the data driving unit 42 to the driving transistor TFT43 such that the shifted degree of the threshold voltage of the driving transistor can be detected in the detection mode, and to allow the organic light emitting diode (OLED) of the corresponding pixel to emit light responsive to the data voltage $V_{DATA}$ inputted from the data driving unit 42 in an emission mode.

The display controller 41 includes a modulator 41A configured to output a preset image signal DATA in a detection mode in which a target OLED is turned off and compensate for the image data DATA for output based upon a compensation value stored in a lookup table 41D in an emission mode, an analog/digital (A/D) converter 41B configured to convert the data voltage $V_{DATA}$ outputted from the data driving unit 42 in the detection mode into a digital signal, and an operator 41C configured to compare a voltage value converted into the digital signal with a pre-stored reference value to operate the shifted degree of a threshold voltage Vth of the driving transistor based upon the comparison result, and store a compensation value corresponding to the shifted degree in the lookup table 41D.

The pixel driving circuit 43 includes a switching transistor TFT41 driven by a scan signal SCAN supplied via a scan line and configured to transfer a data voltage $V_{DATA}$ supplied via a data line to the storage capacitor C41, a switching transistor TFT42 driven by the scan signal SCAN in the detection mode to transfer the data voltage $V_{DATA}$ supplied via the data line to a drain of a driving transistor TFT43 which will be explained later, the storage capacitor C41 connected between a gate terminal of the driving transistor TFT43 and a terminal for a low power voltage Vss to charge the data voltage VDATA, the driving transistor TFT43 configured to supply a driving current corresponding to the data voltage $V_{DATA}$ charged in the storage capacitor C41 to an organic light emitting diode OLED41, and the OLED41 having an anode connected to a terminal for a high power voltage VDD and a cathode connected to the drain of the driving transistor TFT43 to emit light with a brightness corresponding to the driving current.

Figure 5:
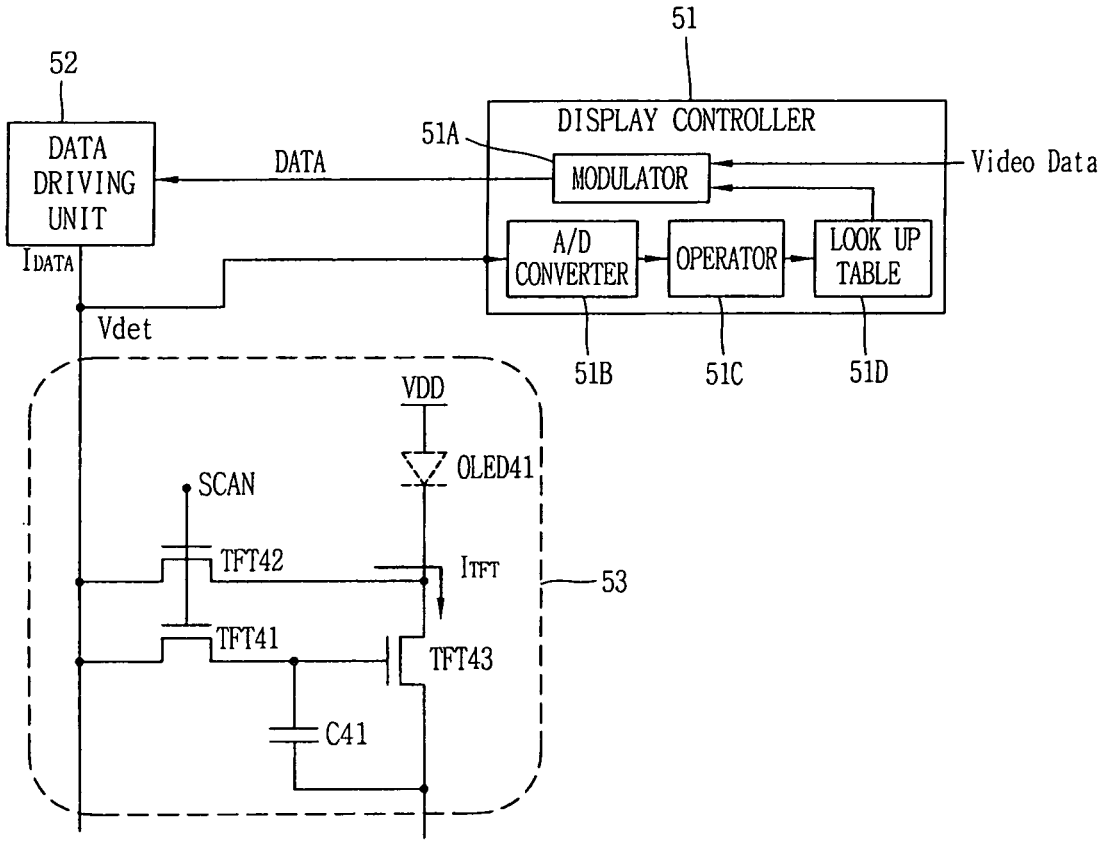
FIG. 5 is a block diagram showing a pixel driving apparatus of an organic electro-luminescence display device in accordance with another exemplary embodiment of the present invention.

FIG. 5 is a block diagram showing a pixel driving apparatus of an organic electro-luminescence display device in accordance with another exemplary embodiment of the present invention.

As shown in FIG. 5, a pixel driving apparatus in accordance with another exemplary embodiment includes a display controller 51 configured to output a preset image signal DATA in a detection mode, detect a voltage outputted to a pixel driving circuit 53 from the data signal DATA, operate the shifted degree of a threshold voltage of a corresponding driving transistor, and accordingly obtain a compensation value, such that when outputting an image signal DATA corresponding to original video data inputted from the exterior in an emission mode, the image signal DATA is compensated for based upon the compensation value for output, a data driving unit 52 configured to generate a data current $I_{DATA}$ corresponding to the image signal DATA inputted from the display controller 51 and output the generated data current $I_{DATA}$ to the pixel driving circuit 53, and the pixel driving circuit 53 configured to allow the organic light emitting diode (OLED) of the corresponding pixel to emit light responsive to the data current $I_{DATA}$ inputted from the data driving unit 52.

The display controller 51 includes a modulator 51 A configured to output a preset image signal DATA in a detection mode in which a target OLED is turned off and thereafter compensate for the image data DATA based upon a compensation value stored in a lookup table 41D in an emission mode, an analog/digital (A/D) converter 51B configured to convert a voltage $V_{det}$, which is outputted from the data driving unit 52 in the detection mode and set on the pixel driving circuit 53, into a digital signal, and an operator 51C configured to compare the voltage value converted into the digital signal with a pre-stored reference value to operate the shifted degree of a threshold voltage Vth of the driving transistor based upon the comparison result, and store a compensation value corresponding to the shifted degree in the lookup table 51D.

The pixel driving apparatus of the organic electro-luminescence display device according to the present invention can be applied both to the voltage programming type pixel driving circuit and the current programming type pixel driving circuit as shown in FIGS. 4 and 5. Hereinafter, driving methods of the pixel driving circuits will be described.

Figure 6A:
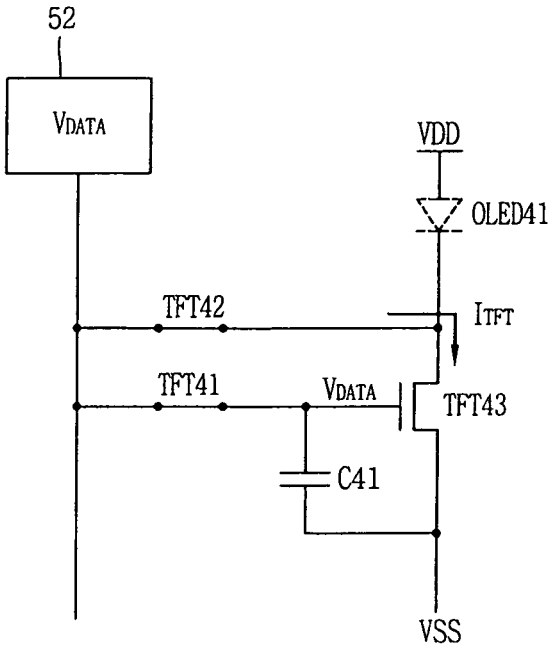
FIGS. 6*a* and 6*b* are views showing on and off equivalent circuits according to switching operations of transistors in a voltage programming type driving circuit of FIG. 4.
Figure 6B:
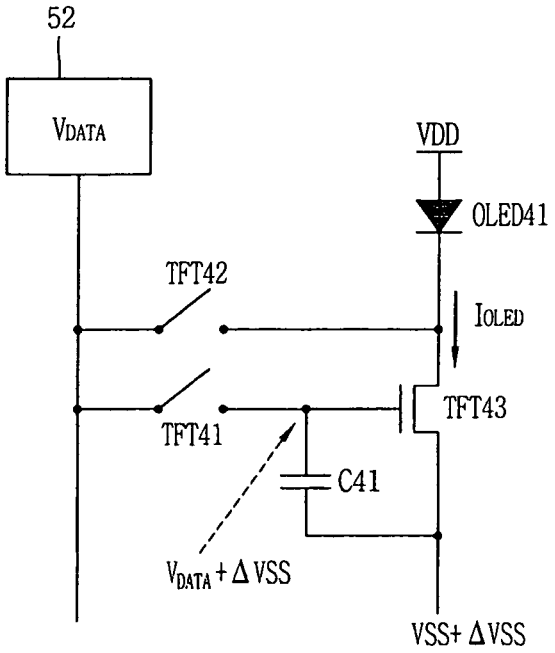
Figure 7:
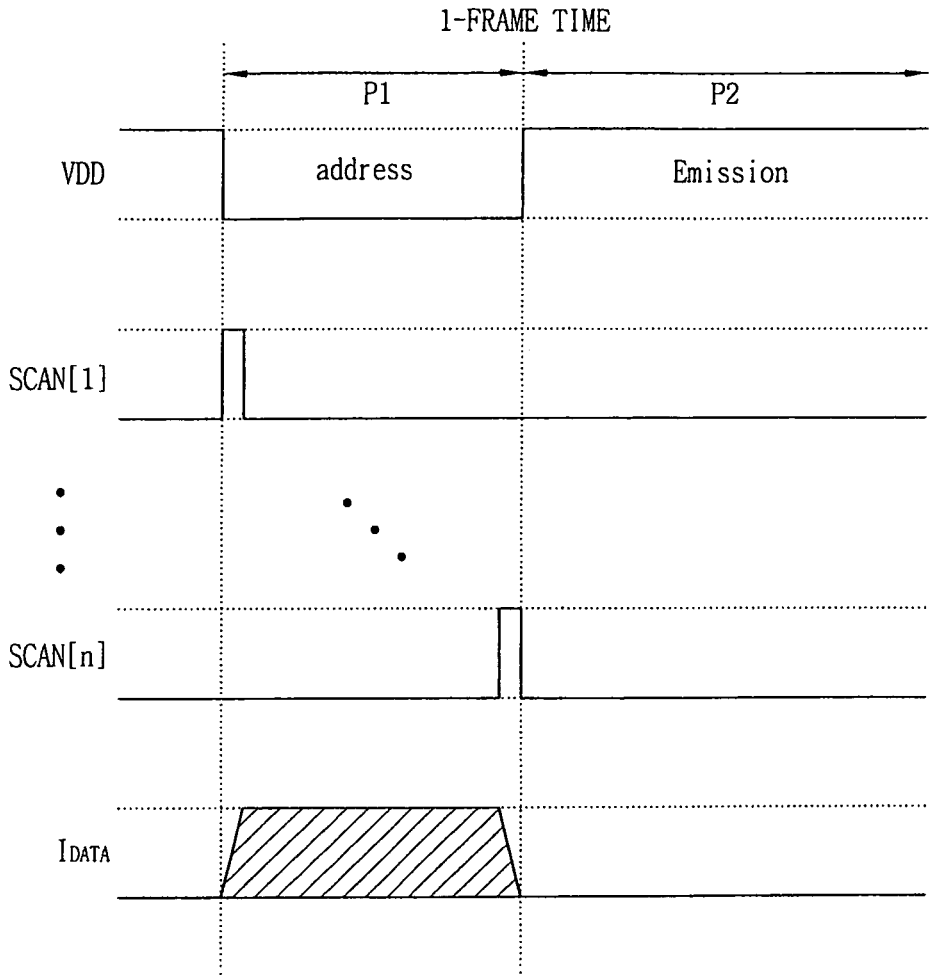
FIG. 7 is a view showing a driving timing of the pixel driving circuit.

First, FIGS. 6*a* and 6*b* are views showing on and off equivalent circuits according to switching operations of the switching transistor TFT41 and the sensing switching transistor TFT42 in the voltage programming type pixel driving circuit 43 of FIG. 4, and FIG. 7 is a view showing a driving timing of the pixel driving circuit 43.

Instead of supplying a high power voltage VDD to the anode of the OLED41 during one frame, the supply of the high power voltage VDD is blocked during a data programming period or data address period P1 (hereinafter, referred to as 'programming period') of the one frame. Under this state, positive scan signals SCAN1~SCANn are sequentially supplied to each horizontal line.

The switching transistor TFT41 is turned on by the corresponding scan signal SCAN during the programming period P1. Accordingly, the data voltage VDATA supplied via the corresponding data line is charged in the storage capacitor C41 via the switching transistor TFT41 so as to be maintained until before an emission period P2. Simultaneously, the switching transistor TFT42 is turned on by a scan signal SCAN supplied to a gate of the switching transistor TFT41. This is for supplying a sensing current in order to compensate for a threshold voltage as will be explained later. Thus, it may not otherwise affect the programming of the data voltage.

Therefore, the pixel driving circuit 43 of FIG. 4 is configured in the programming period P1 as an equivalent circuit of FIG. 6*a*, for example.

Here, the data voltage $V_{DATA}$ charged in the storage capacitor C41 is supplied to the gate of the driving transistor TFT43 and accordingly the driving transistor TFT43 is turned on. However, since the high power voltage VDD has been blocked from being supplied to the anode of the OLED41 as described above, a driving current $I_{OLED}$ of the OLED41 becomes 0.

However, the data voltage $V_{DATA}$ is supplied to the drain of the driving transistor TFT43 via the switching transistor TFT42, so as to flow a driving current as represented by [Formula 1] as follows.

$$I_{TFT} = \frac{1}{2} \cdot \frac{W}{L} \cdot C_{SINx} \cdot \{V_{DATA} - V_{SS} - V_{TH}\}^2 \quad \text{[Formula 1]}$$

Afterwards, upon reaching the emission period P2, the switching transistor TFT41 is turned off, and thusly the gate node is in an electrically floating state. Thus, the pixel driving circuit 43 of FIG. 4 can be configured in the emission period P2 as an equivalent circuit of FIG. 6*b*, for example.

Here, the high power voltage VDD is supplied to the anode of the OLED41 during the emission period P2.

Since the data voltage $V_{DATA}$ stored in the storage capacitor C41 is being supplied to the gate of the driving transistor TFT43, the driving transistor TFT43 is turned on. Accordingly, a current flows toward a terminal for a low power voltage Vss via the OLED41 and the driving transistor TFT 43, such that the OLED 41 can emit light.

Here, the Vss wire on the display panel 40 has a resistance element. Accordingly, a potential of the low power voltage Vss is risen due to the flow of the current via the Vss wire, which is referred to as a Vss rising.

However, in the pixel driving apparatus of the present invention, when the potential of the low power voltage Vss is risen, the gate node of the driving transistor TFT43 is coupled by the storage capacitor C41, by which the voltage of the gate node is equally risen. Accordingly, the problem of the potential rising of the low power voltage Vss can be solved. A driving current of the OLED41 during the emission period P2 can be represented by [Formula 2] as follows.

$$I_{OLED} = \frac{1}{2} \cdot \frac{W}{L} \cdot C_{SINx} \cdot \{(V_{DATA} + \Delta Vss) - (Vss + \Delta Vss) - V_{TH}\}^2 = \frac{1}{2} \cdot \frac{W}{L} \cdot C_{SINx} \cdot \{V_{DATA} - Vss - V_{TH}\}^2 \quad \text{[Formula 2]}$$

Figure 8A:
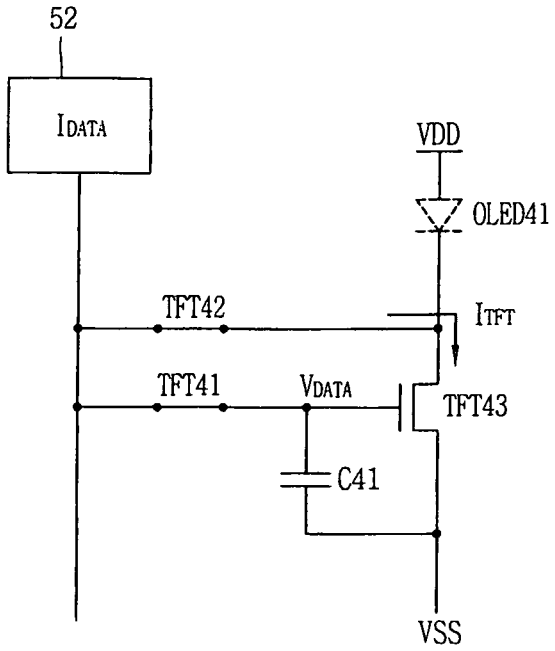
FIGS. 8*a* and 8*b* are views showing on and off equivalent circuits according to switching operations of transistors in a current programming type driving circuit of FIG. 5.
Figure 8B:
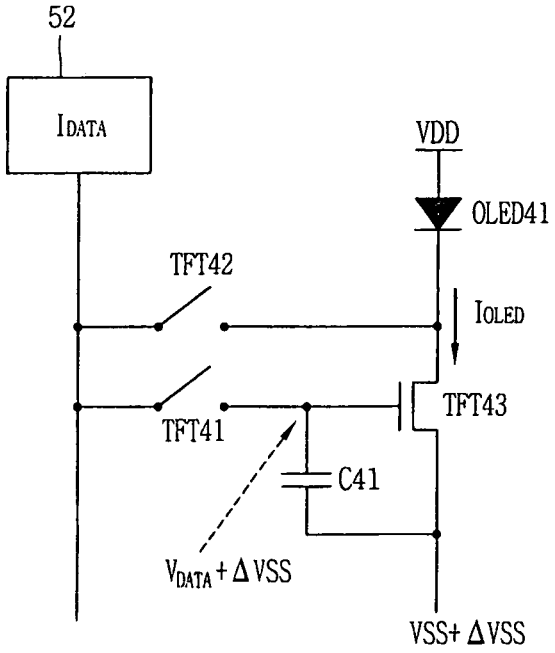

FIGS. 8*a* and 8*b* are views showing on and off equivalent circuits according to switching operations of the switching transistors TFT41 and TFT42 in the voltage programming type driving circuit 53 of FIG. 5.

Instead of supplying a high power voltage VDD to the anode of the OLED41 during one frame, the supply of the high power voltage VDD is blocked during the programming period P1 of the one frame. Under this state, positive scan signals SCAN1~SCANn are sequentially supplied to each horizontal line.

The switching transistor TFT41 is turned on by the corresponding scan signal SCAN during the programming period P1. Accordingly, the data current $I_{DATA}$ supplied via the corresponding data line is transferred to the storage capacitor C41 via the switching transistor TFT41, such that a voltage $V_{DATA}$ having a level for allowing the data current $I_{DATA}$ is set so as to be maintained until before an image period P2. Simultaneously, the switching transistor TFT42 is turned on by a scan signal SCAN supplied to the switching transistor TFT41. This is for supplying a sensing current in order to compensate for a threshold voltage as will be explained later. Thus, it may not otherwise affect the programming of the data voltage.

Therefore, the pixel driving circuit 53 of FIG. 5 is configured in the programming period P1 as an equivalent circuit of FIG. 8*a*, for example.

Here, the data voltage $V_{DATA}$ charged in the storage capacitor C41 is supplied to the gate of the driving transistor TFT43 by the data current $I_{DATA}$ to thusly turn the driving transistor TFT43 on. However, since the high power voltage VDD has been blocked from being supplied to the anode of the OLED41 as described above, a driving current $I_{OLED}$ of the OLED41 becomes 0.

However, the data current $I_{DATA}$ is supplied to the drain of the driving transistor TFT43 via the switching transistor TFT42, so as to flow a driving current as represented by [Formula 3] as follows.

$$I_{OLED} = 0 \quad \text{[Formula 3]}$$

$$I_{TFT} = I_{DATA} = \frac{1}{2} \cdot \frac{W}{L} \cdot C_{SINx} \cdot \{V_{DATA} - Vss - V_{TH}\}^2$$

$$\text{here, } V_{DATA} = \sqrt{\frac{I_{DATA}}{k}} + Vss + V_{TH}$$

Afterwards, upon reaching the emission period P2, the switching transistor TFT41 is turned off, and thusly the gate node is in an electrically floating state. Thus, the pixel driving circuit 53 of FIG. 5 can be configured in the emission period P2 as an equivalent circuit of FIG. 8*b*, for example.

Here, the high power voltage VDD is supplied to the anode of the OLED41 during the emission period P2.

Since the data voltage $V_{DATA}$ stored in the storage capacitor C41 is being supplied to the gate of the driving transistor TFT43, the driving transistor TFT43 is turned on. Accordingly, a current flows toward a terminal for a low power voltage Vss via the OLED41 and the driving transistor TFT43, such that the OLED 41 can emit light.

Here, the Vss wire on the display panel 40 contains a resistance element. Accordingly, a potential of the low power voltage Vss is risen due to the flow of the current via the Vss wire, which is referred to as a Vss rising.

However, in the pixel driving apparatus of the present invention, when the potential of the low power voltage Vss is risen, the gate node of the driving transistor TFT43 is coupled by the storage capacitor C41, by which the voltage of the gate node is equally risen. Accordingly, the problem of the potential rising of the low power voltage Vss can be solved. A driving current of the OLED41 during the emission period P2 can be represented by [Formula 4] as follows.

$$I_{OLED} = \frac{1}{2} \cdot \frac{W}{L} \cdot C_{SINx} \cdot \{(V_{DATA} + \Delta Vss) - (Vss + \Delta Vss) - V_{TH}\}^2 = \frac{1}{2} \cdot \frac{W}{L} \cdot C_{SINx} \cdot \{V_{DATA} - Vss - V_{TH}\}^2 \quad \text{[Formula 4]}$$

However, in case of employing the method for driving pixels commonly using the terminal for the high power voltage VDD as mentioned above, a time excluding the programming period P1 of the one frame is determined as the emission period P2, namely, a lighting time of the OLED41, which may cause the lighting time of the OLED41 to be shortened.

Since a small display panel 40 uses a relatively small number of scan lines, even if pixels are driven by commonly using the terminal for the high power voltage VDD as mentioned above, the programming period P1 may not otherwise be affected and accordingly the lighting time of the OLED41 can be ensured.

However, a large display panel 40 (e.g., the number of scan lines: 768) has a relatively great number of scan lines. In case of driving it in the above manner, the programming period P1 is lengthened relatively long, it is difficult to ensure the lighting time of the OLED41 as long as being required, thereby causing a brightness flicker.

Thus, a method by which the programming period P1 and the lighting time of the OLED41 can sufficiently be ensured, regardless of the small or large display panel 40, is proposed, which will be described with reference to FIG. 9.

The display panel 40 is configured such that a plurality of display panel regions are defined in a horizontal direction so as to include a plurality of neighboring scan lines, pixels within each display panel region defined are thusly allowed to share a corresponding power voltage among high power voltages [VDD.01~VDD.10], which are diverged and supplied from a terminal for the high power voltage VDD, and a programming period P1 and an emission period P2 are determined within a frame period by each defined display panel region.

In this case, wiring formats of scan lines S1~Sn and data lines D1~Dm within the display panel 40 are the same as those within a typical display panel.

However, the display panel 40 is configured such that a plurality of display panel regions are defined in the horizontal direction so as to include a plurality of neighboring scan lines (or horizontal lines), and the high power voltages VDD.01~VDD.10 are supplied to each defined display panel region.

As one example thereof, a large display panel 40 including 600 scan lines S1~Sn can be defined to have 10 display panel regions. Here, each of the 10 display panel regions is defined to include 60 scan lines (e.g., S1~S60, S61~S120, . . . , S541~S600).

For reference, since the display panel 40 to which the present invention is applied has been illustrated as an XGA (extended graphics array) display panel (i.e., 1024×768), 768 scan lines S1~Sn are required. However, for the sake of brief explanation, an example including 600 scan lines is disclosed.

Also, even within the plurality of the display panel regions defined in the horizontal direction, the terminal for the high power voltages VDD.01~VDD.10 is diverged into plural terminals so as to be connected to the corresponding power voltage terminals, respectively. For example, the terminal for the high power voltages VDD.01~VDD.10 is diverged into 60 power terminals within a first display panel region according to the above method, so as to be connected to the corresponding power voltage terminals, respectively.

Figure 9:
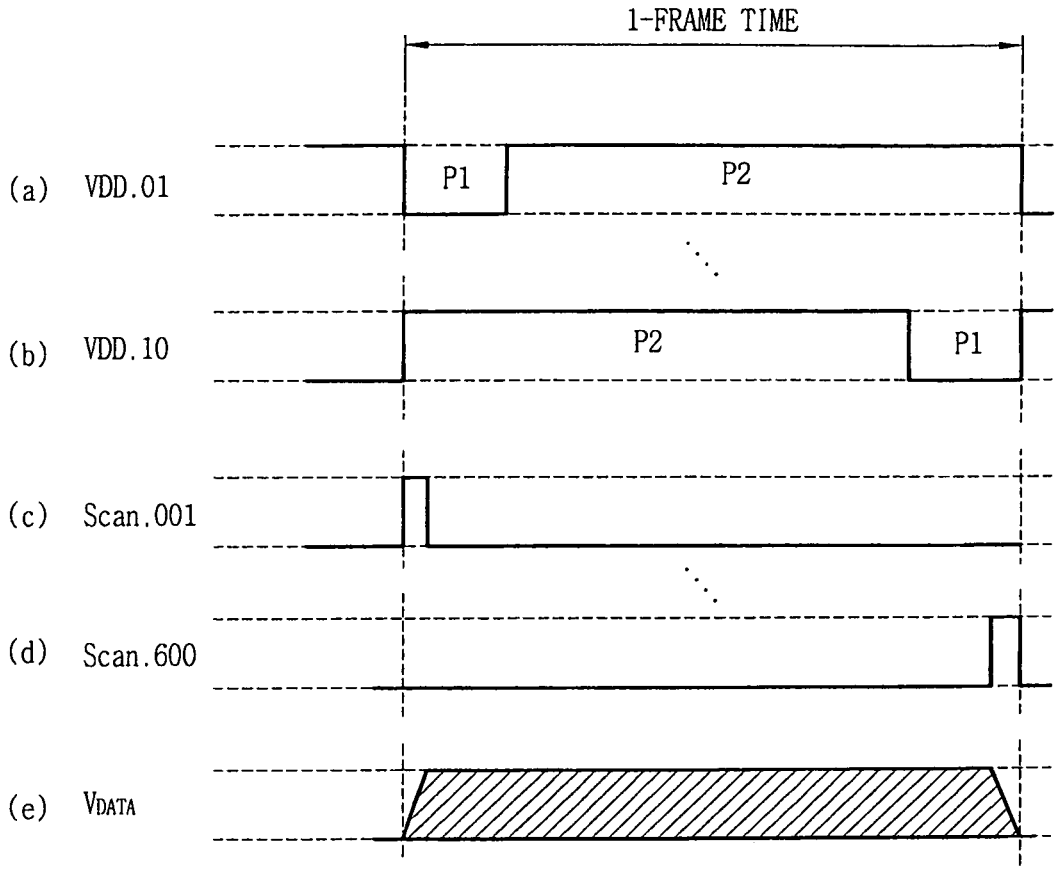
FIGS. 9(*a*) to 9(*e*) are views showing driving timings of a display panel in accordance with the present invention.

FIGS. 9(*a*) to 9(*e*) show timings of the programming period P1, the emission period P2, the scan signals SCAN.001~SCAN.600 and the data voltage $V_{DATA}$ within each display panel region to which each high power voltage VDD.01~VDD.10 which has been defined as shown above is supplied.

In other words, FIGS. 9(*a*) and 9(*b*) show exemplary programming period P1 and emission period P2 set for each display panel region. That is, in case of 10 display panel regions being defined for the display panel 40, one frame is divided among the ten such that the period of one-tenth frame is set to the programming period P1 of each display panel region and the rest period of nine-tenth frame is set to the emission period P2.

FIGS. 9(*c*) and 9(*d*) show timings of scan signals SCAN.001~SCAN.600 for each display panel region, by which it can be seen that such timings are the same to the typical scan timing.

FIG. 9(*e*) shows a timing of the data voltage $V_{DATA}$ supplied to each display panel region, as a target, via the data lines D1~Dm. It can also be noticed that such timing in FIG. 9(*e*) is the same to the typical scan timing.

Here, for example, upon blocking the high power voltage VDD.01 of a first display panel region, the scan signal SCAN.001~SCAN.600 is supplied so as to program the data voltage on the first display panel region. Afterwards, at the same time of supplying the high power voltage VDD.01, an emission for the first display panel region is executed. Such programming and emission can be executed in the same manner for the next display panel region.

Accordingly, the current amount managed by the terminal for each high power voltage VDD.01~VDD. 10 can be drastically reduced, and also a time for the emission can sufficiently be ensured.

Figure 10:
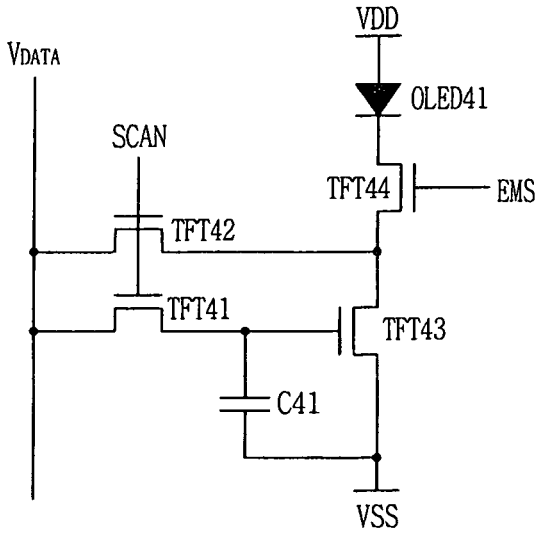
FIG. 10 is a view showing a pixel driving circuit including a switching transistor for blocking the supply of a high power voltage.

In the above description, several methods may be employed to block the supply of the high power voltage VDD such that a current cannot flow via the OLED41 and the driving transistor TFT43 during the programming period P1 of one frame. One exemplary method implemented by using a switching transistor is illustrated in FIG. 10.

That is, drain and source of the switching transistor TFT44 are connected between the cathode of the OLED41 and the drain of the driving transistor TFT43. The display controller 41 then outputs a 'low' switching control signal EMS to the gate of the switching transistor TFT44 during the programming period P1 so as to turn the switching transistor TFT44 off.

As such, the description has been given of the driving method of solving a problem that Vss potential is risen in the voltage programming type pixel driving circuit 43 and the current programming type pixel driving circuit 53 both having the present invention applied.

Hereinafter, detailed description will be made of a process in which the shift of threshold voltages Vth of driving transistors of the voltage programming type pixel driving circuit 43 and the current programming type pixel driving circuit 53 in the pixel driving circuit, thus to compensate for data voltages according to the detection.

First, a process of detecting the shift of the threshold voltage Vth of the driving transistor TFT43 in the voltage programming type pixel driving circuit 43 in FIG. 4 so as to compensate for a data voltage $V_{DATA}$ accordingly will be described.

The modulator 41A of the display controller 41 outputs a preset image signal DATA to the data driving unit 42 at a certain time (e.g., in a detection mode) when a target OLED41 on the pixel driving circuit 43 does not emit light.

Accordingly, the data driving unit 42 amplifies the voltage of the image signal DATA inputted from the modulator 41 A via an operating amplifier OP1, thus to output the amplified voltage to the corresponding pixel driving circuit 43 via a resistance R1.

Here, the switching transistors TFT41 and TFT42 are all turned on by a scan signal SCAN. Accordingly, the data voltage $V_{DATA}$ outputted from the data driving unit 42 is charged in the storage capacitor C41 via the switching transistor TFT41.

Since the driving transistor TFT43 is turned on by the data voltage $V_{DATA}$ charged in the storage capacitor C41, a corresponding current $I_{FTF43}$ then flows via the driving transistor TFT43 responsive to the data voltage $V_{DATA}$ outputted from the data driving unit 42.

Here, an output terminal voltage $V_{det}$ of the operating amplifier OP1 is converted into a digital signal in the A/D converter 41B. The output terminal voltage $V_{det}$ of the operating amplifier OP1 then has a value obtained by multiplying the value of the current $I_{TFT43}$ by the value of the resistance R1 (i.e., $V_{det}=I_{TFT43}\times R1$).

The operator 41C compares the voltage value converted into the digital signal with a pre-stored reference value, and operates the degree of deterioration of the driving transistor TFT43, namely, the degree of the shift of the threshold voltage Vth, based upon the comparison result. The operator 41C stores a compensation value corresponding to the operated degree of the shift in a lookup table 41D.

Afterwards, in an emission mode for outputting an image signal DATA corresponding to original video data from the exterior, the modulator 41A compensates for the image signal DATA based upon the compensation value stored in the lookup table 41 D for output.

Accordingly, the data voltage $V_{DATA}$ outputted from the data driving unit 42 is outputted as the compensated value corresponding to the shifted degree of the threshold voltage Vth of the driving transistor TFT43.

Therefore, even if the shift of the threshold voltage Vth of the driving transistor TFT43 occurs, the OLED41 can normally emit light by the compensation.

On the other hand, a process of detecting the shift of the threshold voltage Vth of the driving transistor TFT43 in the current programming type pixel driving circuit 53 in FIG. 5 so as to compensate for a data current $I_{DATA}$ accordingly will be described as follows.

The modulator 51A of the display controller 51 outputs a preset image signal DATA to the data driving unit 52 at a certain time (e.g., in a detection mode) when a target OLED41 on the pixel driving circuit 53 does not emit light.

Accordingly, the data driving unit 52 outputs the current $I_{DATA}$ corresponding to the image signal DATA inputted from the modulator 51A to the corresponding pixel driving circuit 53.

Here, the switching transistors TFT41 and TFT42 are all turned on by a scan signal SCAN. Accordingly, the data current $I_{DATA}$ outputted from the data driving unit 52 is supplied to the storage capacitor C41 via the switching transistor TFT41, and the corresponding voltage is charged (set) in the storage capacitor C41.

The driving transistor TFT43 is then turned on by the voltage set in the storage capacitor C41. Here, the data current $I_{DATA}$ outputted from the data driving unit 52 is transferred to the drain of the driving transistor TFT43 via the switching transistor TFT42, thereby allowing the flow of a corresponding current $I_{TFT43}$.

Here, the voltage set in the storage capacitor C41 is outputted as a detection voltage $V_{det}$ to the output terminal of the data driving unit 52, thus to be converted into a digital signal in the A/D converter 51B.

The operator 51C compares the voltage value converted into the digital signal with a pre-stored reference value, and operates the degree of deterioration of the driving transistor TFT43, namely, the shifted degree of the threshold voltage Vth, based upon the comparison result. The operator 51C stores a compensation value corresponding to the operated degree of the shift in the lookup table 51D.

Afterwards, in an emission mode for outputting the image signal DATA corresponding to original video data from the exterior, the modulator 51A compensates for the image signal DATA based upon the compensation value stored in the lookup table 51D for output.

Accordingly, the data current $I_{DATA}$ outputted from the data driving unit 52 is outputted as the compensated value corresponding to the shifted degree of the threshold voltage Vth of the driving transistor TFT43.

Therefore, even if the shift of the threshold voltage Vth of the driving transistor TFT43 occurs, the OLED41 can normally emit light by the compensation.

In the meantime, in another exemplary embodiment of the present invention, a separate current sensing line is provided and the current of a driving transistor on a pixel driving circuit is sensed by using a specific interval (time), such as a black data insertion (BDI). Based upon the sensed current, the shifted degree of the threshold voltage Vth of the driving transistor is analyzed as described above and compensated for. This is now described.

Figure 11:
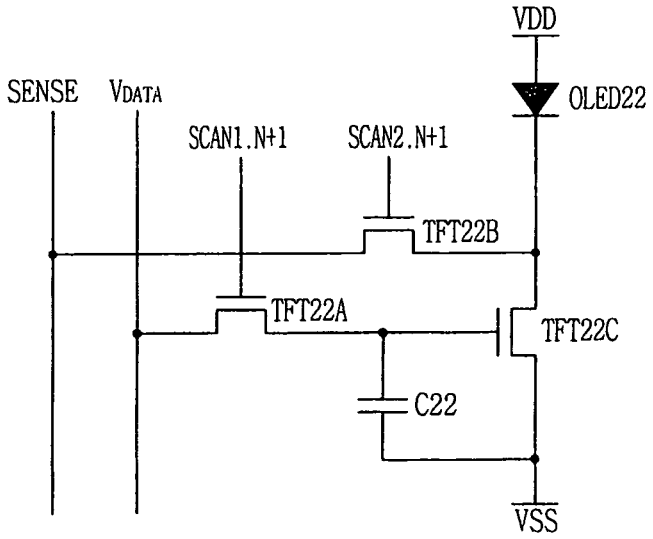
FIG. 11 is a view showing a basic pixel driving circuit in accordance with another exemplary embodiment of the present invention.

FIG. 11 shows a basic pixel driving circuit in accordance with another exemplary embodiment of the present invention. As shown in FIG. 11, a pixel driving circuit in accordance with another exemplary embodiment includes a switching transistor TFT22A turned on by a scan signal SCAN1 in a detection mode for detecting a programming period or the shifted degree of a threshold voltage of a driving transistor and configured to transfer a data voltage $V_{DATA}$ supplied via a data line to a storage capacitor C22, a switching transistor TFT22B turned on by a scan signal SCAN2 in the detection mode and configured to transfer a sensing voltage supplied via a separately disposed sensing line to a drain of a driving transistor TFT22C, the storage capacitor C22 connected between a gate terminal of the driving transistor TFT22C and a terminal for a low power voltage Vss and configured to charge the data voltage VDATA, a driving transistor TFT22C configured to allow a driving current corresponding to the data voltage $V_{DATA}$ charged in the storage capacitor C22 to be supplied to an OLED 22 in an emission mode, and configured to be driven by the charged data voltage $V_{DATA}$ supplied to the gate and the sensing voltage supplied to the drain via the switching transistor TFT22B, and the OLED22 having an anode connected to a terminal for a high power voltage VDD and a cathode connected to the drain of the driving transistor TFT22C and configured to emit light with a brightness corresponding to the driving current. Hereinafter, the operation of the pixel driving circuit in accordance with the another exemplary embodiment having such configuration will be described in detail with reference to FIG. 14.

Figure 12:
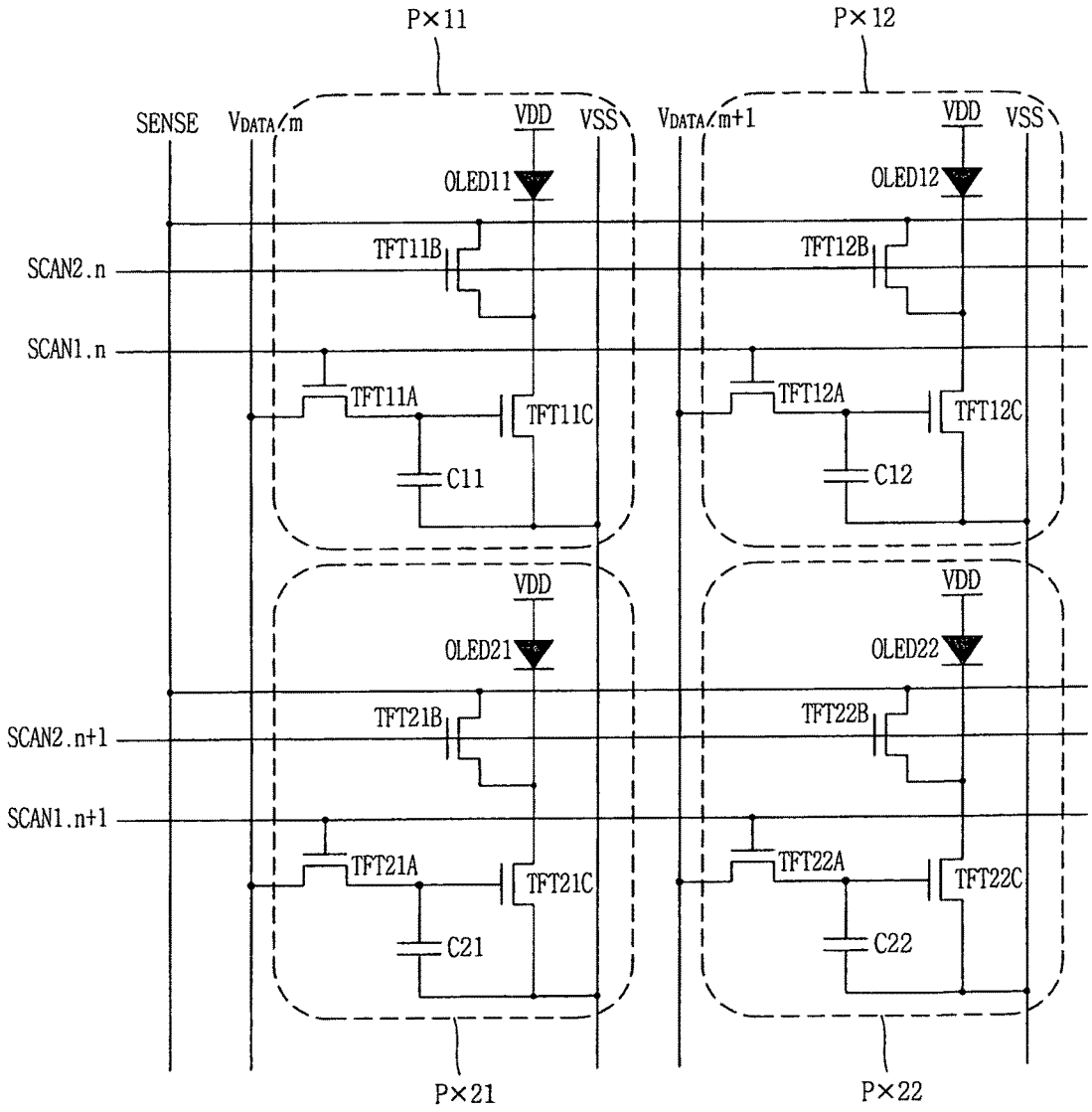
FIG. 12 is a view partially showing a display panel to which the another exemplary embodiment is applied.
Figure 13A:
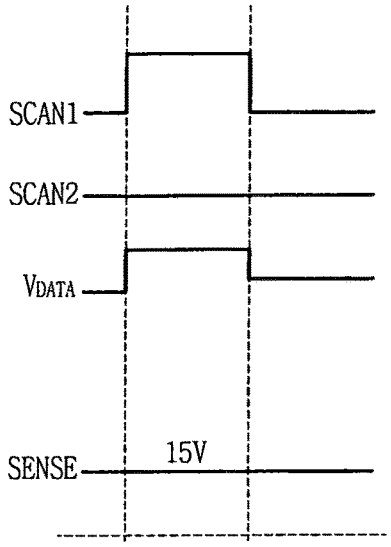
FIG. 13*a* is a timing view of a programming period of FIG. 11.
Figure 13B:
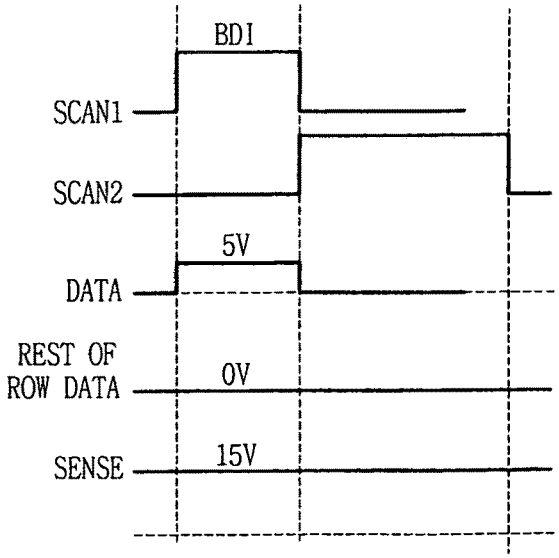
FIG. 13*b* is a timing view of a current sensing in a detection mode.

The basic pixel driving circuit of the another exemplary embodiment is configured as shown in FIG. 11. Such pixel driving circuit is arranged on a display panel in a matrix. FIG. 12 shows part of the display panel. FIG. 13*a* is a timing view of a programming period of FIG. 11, and FIG. 13*b* is a timing view of a current sensing in a detection mode.

The programming operation using two transistors TFT22A and TFT22C and one storage capacitor C22 in each pixel driving circuit (e.g., PX22) is the same to that in a typical pixel driving circuit.

That is, as shown in FIG. 13*a*, 'high' scan signal SCAN1 and 'high' data voltage $V_{DATA}$ are supplied during a programming period (or data address period). Accordingly, the switching transistor TFT22A is turned on, and thusly the data voltage VDATA supplied via a data line is charged in the storage capacitor C22, so as to be maintained until before an emission period.

Afterwards, during the emission period, the driving transistor TFT22C is turned on by the data voltage $V_{DATA}$ charged in the storage capacitor C22 such that a current as much as corresponding to the data voltage $V_{DATA}$ can flow via the OLED22. Hence, the OLED22 can emit light with a brightness of the corresponding current amount.

On the other hand, a current of the corresponding driving transistor is detected by selecting a pixel driving circuit by a certain period using a specific interval (time), such as the BDI. An example of detecting a current by selecting a pixel driving circuit PX22 will be described herein.

First, at a first step, a 'high' scan signal SCAN1.n+1 of a scan line and a scan signal SCAN2.n of another scan line are outputted for a BDI interval of one frame. Accordingly, switching transistors TFT21A and TT22A of pixel driving circuits PX21 and PX22 are turned on, whereas switching transistors TFT11A and TFT12A of another pixel driving circuits PX11 and PX12 are turned off.

Here, 5V of data voltage $V_{DATA.m+1}$ of a data line is supplied, and 0V (or negative voltage) of data voltage $V_{DATA.m}$ of another data line is supplied. The voltage 5V is charged in the storage capacitor C22 of the pixel driving circuit PX22, and no voltage is charged in storage capacitors C11, C12 and C21 of the rest pixel driving circuits PX11, PX12 ad PX21.

Afterwards, at a second step, a 'low' scan signal SCAN1.n+1 of the scan line is outputted so as to turn off the switching transistors TFT21A and TFT22A of the pixel driving circuits PX21 and PX22. Simultaneously, a 'high' scan signal SCAN2.n+1 of a scan line is outputted so as to turn on the switching transistors TFT21B and TFT22B.

Under this state, 15V of sensing signal SENSE of a sensing line is supplied. Accordingly, the 15V of sensing signal SENSE supplied via the sensing line is transferred to the drain of the driving transistor TFT22C via the switching transistor TFT22B of the pixel driving circuit PX22; however, it doest not affect the rest of pixel driving circuits PX11, PX12 and PX21.

That is, in the pixel driving circuits PX11 and PX12, since the switching transistors TFT11B and TFT12B are turned off, the 15V of voltage supplied via the sensing line is not transferred to the drain of the driving transistors TFT11C and TFT12C. Also, in the pixel driving circuit PX21, since the switching transistor TFT21B is turned on but a gate voltage of the driving transistor TFT21C is 0V, the driving transistor TFT21C is maintained in a turn-off state.

Here, the OLED22 of the pixel driving circuit PX22 is turned off due to a reverse voltage or the blocking of the high power voltage VDD.

As a result, through such processes as described above, the driving transistor TFT22C of the pixel driving circuit PX22 is driven in the detection mode. Accordingly, the shift of the threshold voltage Vth is detected, as shown in FIGS. 4 and 5, via the sensing line, thus to be compensated for as much as being shifted.

Figure 14:
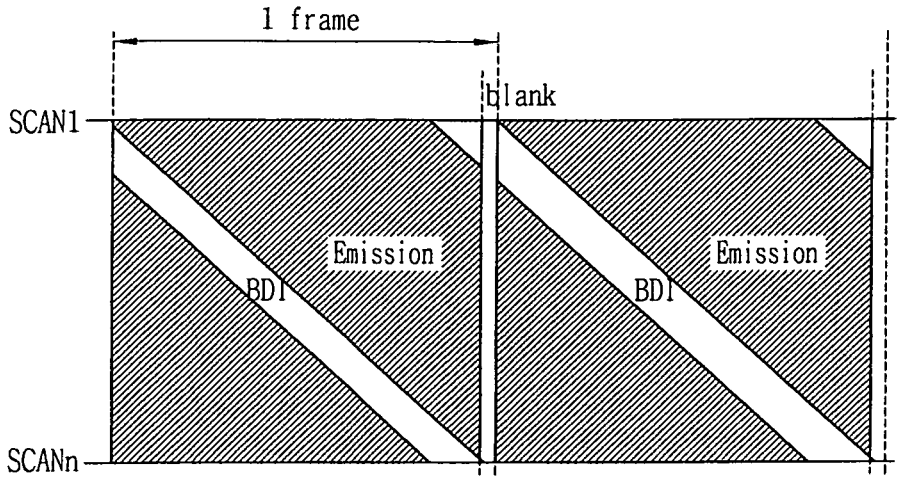
FIG. 14 is a schematic view of a screen indicating BDI intervals having the present invention applied thereto.

FIG. 14 shows an exemplary interval, namely, BDI interval for analyzing the shifted degree of a threshold voltage Vth of a driving transistor in accordance with another exemplary embodiment of the present invention. Here, x-axis denotes an interval corresponding to a frame time, and y-axis denotes an interval for which a scan signal SCAN is supplied on a display panel. The BDI interval corresponds to 10% of one frame. During this BDI interval, an emission of the OLED is not executed. Thus, the number of detection of the shift of the threshold voltage is determined according to a BDI driving method. For example, for a BDI of 9:1, the maximum number of pixels, for which the shift of the threshold voltage is detectable, is 10 per one frame. Hence, each pixel is sequentially selected by a certain period for each BDI of one frame, and at each selection, the shifted degree of the threshold voltage Vth of the corresponding driving transistor can be analyzed.

The present invention can advantageously improve the compensation for the deterioration of a driving transistor by detecting the shifted degree of a threshold voltage of the driving transistor due to the deterioration of the driving transistor in a pixel driving circuit of an organic electroluminescence display device, and compensating a data voltage according to the detection result.

Also, in the pixel driving circuit of the organic electroluminescence display device, the shift of the threshold voltage of a driving transistor can be detected at a period other than an emission period by using sensing line and switching transistors, so as to reduce power consumption.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

What is claimed is:

1. A pixel driving apparatus of an organic electro-luminescence display device comprising:

a pixel driving circuit comprising:

a driving voltage supplied to power an organic light-emitting diode (OLED), the driving voltage turned off during a programming period of a frame, and turned on during an emission period of the frame so that the OLED can emit light, wherein the frame includes the programming period and the emission period;

a driving transistor connected to a storage capacitor, the driving transistor configured to supply a driving current to the OLED during the emission period;

a first switching transistor driven by a scan signal supplied via a scan line sequentially supplied during the programming period, which precedes the emission period, every frame to 1 to N scan lines of the organic electro-luminescent display device, the first switching transistor being turned on during the programming period to transfer a data voltage supplied from a data driving unit, via a data line, to the storage capacitor and turned off during the emission period;

a second switching transistor being turned on during the programming period to transfer the data voltage from the data driving unit to a drain of the driving transistor to supply a sensing current to the driving transistor and turned off during the emission period, wherein each of the 1 to N scan lines is scanned during the programming period in the frame, wherein the data voltage supplied directly via data line is transferred to the storage capacitor simultaneous with the transfer of the data voltage supplied directly via the date line to the drain of the driving transistor, a display controller having an analog/digital (A/D) converter to receive and convert the data voltage stored in the storage capacitor in the programming period, calculate a shifted degree of a threshold voltage of the driving transistor in response to the converted data voltage, and compensate for an image data using a compensation value according to a calculation result.

2. The apparatus of claim 1, wherein the display controller comprises:

a modulator to output a preset image signal in the programming period and compensate for the image signal based upon a compensation value stored in a lookup table in the emission period; and an operator to compare the converted value into the digital signal with a pre-stored reference value, operate the shifted degree of the threshold voltage of the driving transistor on the pixel driving circuit based upon the comparison result, and store a compensation value corresponding to an operation result in the lookup table.

3. The apparatus of claim 1, wherein the data driving unit generates a data voltage corresponding to the image signal inputted from the display controller to output to the pixel driving circuit.

4. The apparatus of claim 1, wherein the pixel driving circuit includes a voltage programming type pixel driving circuit.

5. The apparatus of claim 1, wherein a third switching transistor is used to block a high power voltage from being provided to the organic light emitting diode.

6. The apparatus of claim 5, wherein the third switching transistor is configured to be turned on by a switching control signal provided from the display controller.

7. The apparatus of claim 1, wherein the organic electro-luminescence display device comprises n display panel regions, wherein the frame comprises n non-overlapping programming periods for each of the n display panel regions, and wherein a remaining period of the frame for each of the n display panel regions is the emission period for each of the n display panel regions.

8. The apparatus of claim 1, wherein the driving current is compensated to account for a resistance of a lower power voltage terminal wire VSS of the OLED.

* * * * *